United States Patent [19]

Koon

[11] 4,312,371

[45] Jan. 26, 1982

[54] UMBRELLAS

[76] Inventor: Tan C. Koon, 768 Block 125 Margaret Dr., Singapore 3, Singapore

[21] Appl. No.: 50,417

[22] Filed: Jun. 20, 1979

[51] Int. Cl.[3] ..... A45B 11/00; A45B 15/00

[52] U.S. Cl. ..... 135/19.5; 135/5 R; 135/20 R

[58] Field of Search ..... 135/5 R, 7.1 R, 19.5, 135/20 R, 5 C

[56] References Cited

U.S. PATENT DOCUMENTS

| | | | |
|---|---|---|---|
| 1,169,702 | 1/1916 | Washburn | 135/5 R |
| 1,973,540 | 9/1934 | Nelson | 135/7.1 R |
| 2,554,204 | 5/1951 | Mueller | 135/19.5 |
| 2,828,758 | 4/1958 | Moro | 135/5 R |
| 3,394,720 | 7/1968 | Moss | 135/5 R |
| 3,441,038 | 4/1969 | Mathews | 135/20 R X |

FOREIGN PATENT DOCUMENTS

| | | | |
|---|---|---|---|
| 1019528 | 10/1952 | France | 135/5 R |
| 270418 | 11/1950 | Switzerland | 135/19.5 |

*Primary Examiner*—J. Karl Bell

[57] ABSTRACT

An umbrella comprises a cover of flexible material attached at its periphery to a resilient one-piece ring. A handle is connected at one end to the cover and at the other end to the ring and serves to support the umbrella in an open or erect position. The ring is sufficiently resilient to be twisted so as to form three loops for the purpose of storage and to return subsequently to its open position.

6 Claims, 15 Drawing Figures

FIG.1.
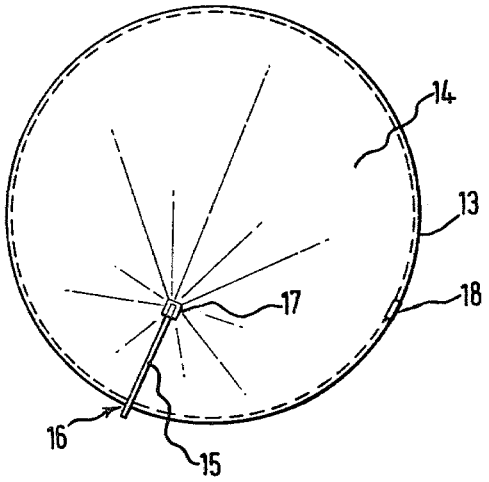
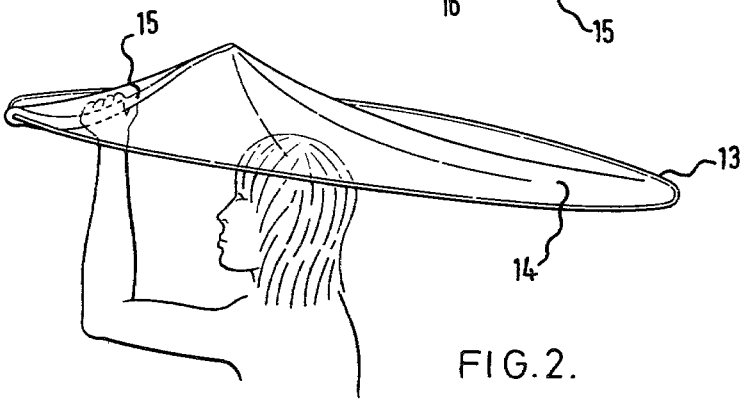
FIG.2.
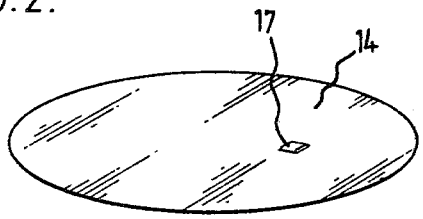
FIG.3.
FIG.4.
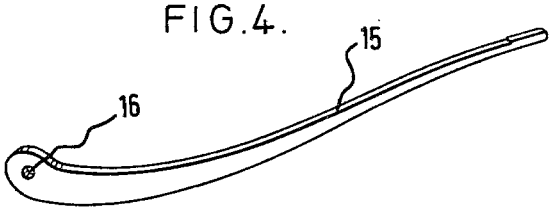
FIG.5.
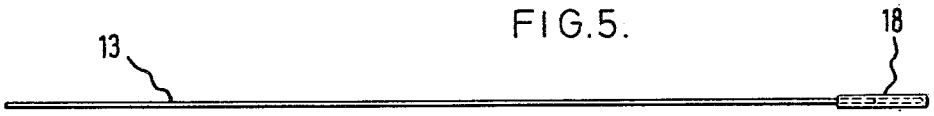

UMBRELLAS

The present invention relates to umbrellas. The term "umbrella" as used herein is intended to include umbrellas, parasols, and all other similar devices.

According to the invention there is provided an umbrella comprising a resilient one-piece ring attached to a cover made of flexible material with a handle connected at its respective ends to both the ring and the cover so as to support the flexible cover in its erect position when the umbrella is in use.

One preferred embodiment comprises a one-frame umbrella of simple construction which entirely dispenses with the ribs, vertical shaft and handle and other additional parts of some known umbrellas. This umbrella is detachable, extremely light in weight, easily manufactured without intensive labor at low cost from a minimum of inexpensive material, and easily shipped and put in condition for use with rapid folding and unfolding.

Another preferred umbrella comprises a one-piece resilient detachable loop, sewn, welded or attached to the periphery of a non-rigid cover (e.g. nylon, silk, cotton or polyethylene) with a handle connected to both the rim and cover so as to support the flexible cover in its erect position in use. The resilient loop which forms the frame of the umbrella is of such resilience that it may be twisted automatically into three loops to store the umbrella and, when pressure is released, springs back to the original position. The umbrella is detachable as its various parts can be dismantled by simply disengaging the resilient loop from the cover by disconnecting one end of the resilient material from a sleeve joint and gently pulling it out of the cover, which, at the same time, releases the handle.

The invention will be further described, by way of example, with reference to the accompanying drawings in which:

FIG. 1 is a view from below of a preferred umbrella in its "open" position;

FIG. 2 is a side perspective view of the umbrella of FIG. 1 in its open position when in use;

FIG. 3 shows a sheet of flexible material to be sewn welded or otherwise attached to a frame as an umbrella cover;

FIG. 4 shows a handle illustrating its aperture;

FIG. 5 shows resilient material in the form of a flat rigid steel wire strip with a sleeve joint at one end to connect the other end thereto to form a resilient loop or ring;

Figure 6:
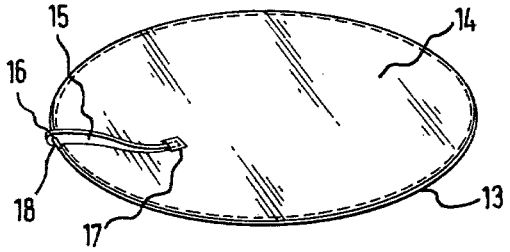
FIG. 6 is an underside perspective view of the umbrella of FIG. 1 in an open position.

Referring to FIG. 1 of the drawings, the umbrella shown comprises a length of resilient material 13, such as flat rigid steel wire strip having been attached to a handle 15 through an aperture 16 before one end of the wire was connected to a sleeve joint 18 at the other end to form a resilient ring or loop 13. The resilient loop 13 is then sewn, welded or otherwise attached along the periphery of a non-rigid waterproof cover 14 to form the frame of the umbrella. The handle 15 is connected to the rim of the resilient loop 13 at one end and is attached at its other end to a strap or flap 17 positioned at a point of the cover 14 which holds the tip of the handle 15 in position. Thus, when the handle 15 is lifted to an erect position, as in FIG. 2, an umbrella canopy is formed to shield the user from the rain or other adverse weather conditions.

FIG. 3 is a plan view of a sheet of flexible material such as nylon, silk, polyethylene, rayon or cotton to be sewn or welded or attached in some other way to the frame as an umbrella cover 14. FIG. 4 shows the handle 15 illustrating its aperture 16 through which one end of the resilient material is passed to meet the other end provided with the sleeve joint 18 (FIG. 5) which connects the two ends together to form a resilient loop 13 with a handle 15 attached to it. The other end of the handle is inserted into the flap 17 positioned so that the handle is extended along a major axis of the cover 14, thus securing the tip of the handle in a fixed position.

As in FIG. 1, FIG. 6 is an underside perspective view of the preferred umbrella in an open position with all the parts assembled and ready for use. When a user lifts up the handle 15, a canopy will be automatically formed because the weight of the structure, comprising the cover 14 and the resilient one-piece loop 13, is suspended from the tip of the handle 15 while the base of the handle 15 is connected to the rim of the resilient loop 13.

Figure 7:
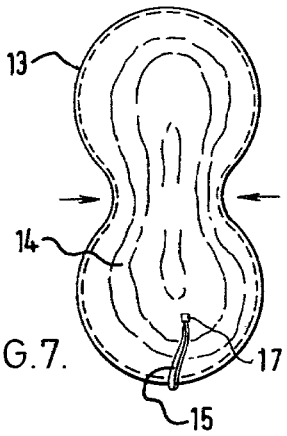
FIG. 7 shows the umbrella of FIG. 1 during folding.
Figure 8:
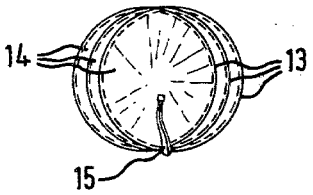
FIG. 8 shows the umbrella of FIG. 1 folded into three loops.
Figure 9:
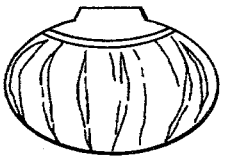
FIG. 9 shows a small bag for containing the folded umbrella.
Figure 10:
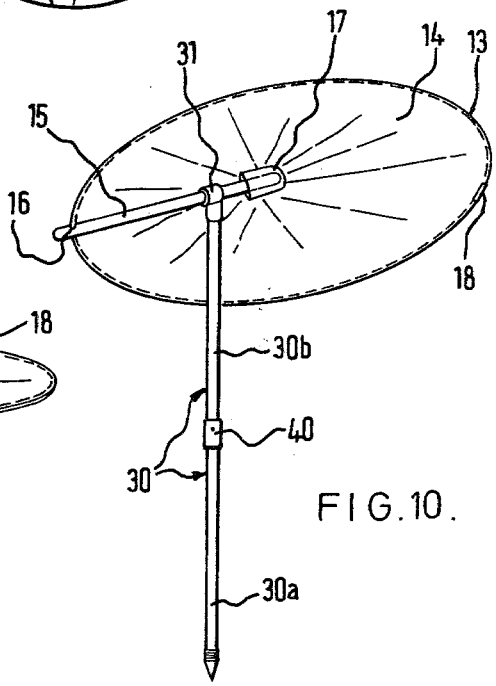
FIG. 10 shows the component parts of a preferred beach or garden umbrella or parasol.
Figure 11:
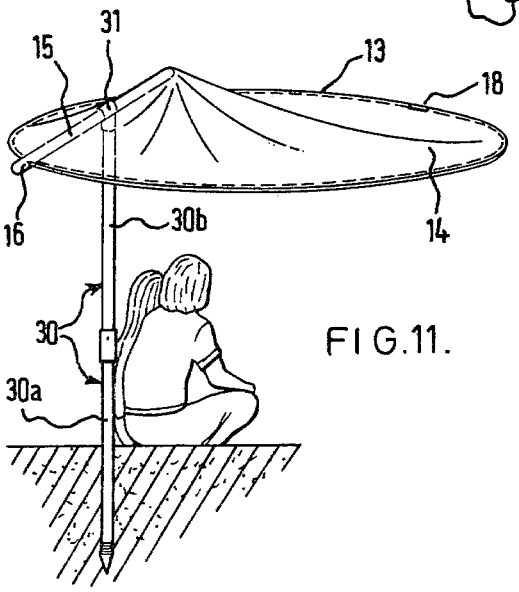
FIG. 11 shows the beach or garden umbrella or parasol of FIG. 10 in use.
Figure 12:
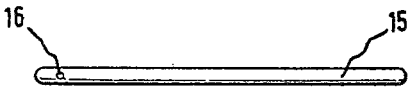
FIG. 12 is a handle of the umbrella or parasol of FIG. 10 illustrating its aperture.
Figure 13:
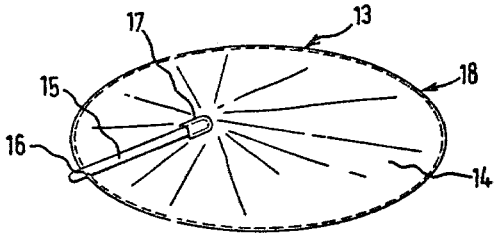
FIG. 13 is an underside perspective view of the cover of the umbrella or parasol of FIG. 10 with a handle attached to it.
Figure 14:
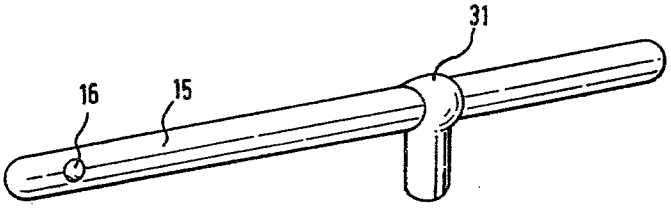
FIG. 14 shows an angular fitting gripping the handle, of the umbrella or parasol of FIG. 10 in an elevated erect position.
Figure 15:
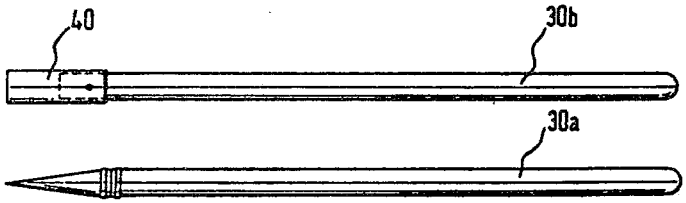
FIG. 15 shows the pole of the umbrella or parasol of FIG. 10 in two sections.

When not in use, the umbrella can be folded into approximately one third its original diameter (FIGS. 7 and 8) by simply applying some pressure on opposite sides of the resilient loop 13, as indicated by the arrow in FIG. 7, to collapse the frame of the umbrella and twisting it into three loops of approximately equal diameters. This is possible because of the natural elasticity of the resilient loop 13. A bag (FIG. 9) is provided for the folded umbrella. The folded umbrella can be restored to its original position without distortion of shape when pressure is released so that it springs back to its original position.

A modified umbrella, similar to that shown in FIGS. 1 to 8, is shown in FIGS. 10 to 15, in which the umbrella is mounted on a supporting pole for use as a beach or garden umbrella, parasol or the like. Like numerals refer to like parts in all the drawings and previously described parts will not be further described.

Referring to FIGS. 10 to 15 of the drawings, the parasol further comprises a supporting pole 30 in two sections 30*a* and 30*b* and an angular fitting 31 which functions as a gripping member on the handle 15 to hold it in an erect position thereby lifting the cover 14 in use.

The lower section 30*a* is driven into the ground while its other end is joined or connected to the upper section 30*b* by means of a sleeve joint 40 attached to the upper section 30*b*.

The angular fitting 31 is slipped over the handle 15 (FIG. 14) and mounted on the upper section 30*b* of the supporting pole, after which the other end of the handle 15 may be inserted into the flap 17 to hold it in position. Thus, when the handle 15 is elevated in an erect position with the angular fitting 31 connected to the pole 30, a canopy is formed to shield the user from rain and other adverse weather conditions. Moreover, if the diameter of the base of the angular fitting 31 is slightly larger than the diameter of the supporting pole 30*b*, the canopy is rendered rotatable.

All parts of the parasol are detachable and, for this purpose, the angular fitting 31 is slipped out of the handle 15 and the two sections 30*a* and 30*b* of the pole dismantled. One end of the resilient strip of material may then be disconnected and the strip gently pulled away from the cover 14, in which process the handle 15 is automatically released. All the component parts of the parasol or umbrella can be fitted in a small bag.

I claim:

1. An umbrella comprising a resilient one-piece ring, a cover made of flexible material, and a handle having first and second ends, wherein said cover is attached adjacent its periphery to said resilient one-piece ring and said first and second ends of said handle are connected to said resilient one-piece ring and to said cover, respectively, whereby said handle supports said umbrella in its erect position.

2. An umbrella as set forth in claim 1, wherein said resilient one-piece ring is sufficiently resilient to be twisted into at least two loops for storage and to return automatically to its open position when released.

3. An umbrella as set forth in claim 2, wherein said one-piece ring is sufficiently resilient to be twisted into three loops.

4. An umbrella as set forth in claim 1, wherein said resilient ring comprises a strip of material having ends joined together by a sleeve joint and said umbrella can be dismantled by disengaging one of said ends of said strip of material from said sleeve joint and pulling said strip of material out of said cover.

5. An umbrella as set forth in claim 1, wherein there is provided an angular fitting for holding said handle in an erect position and for rotatably mounting said umbrella on a supporting pole.

6. An umbrella comprising a resilient one-piece ring twisted into three loops, a handle having first and second ends, and a cover of flexible material having a periphery to which said resilient one-piece ring is attached, said first end of said handle being connected to said resilient one-piece ring and said second end being connected to said cover, said resilient one-piece ring being sufficiently resilient to return to a single-loop configuration.

* * * * *